United States Patent [19]

Ozeki et al.

[11] Patent Number: 4,787,436

[45] Date of Patent: Nov. 29, 1988

[54] GAS VENTING DEVICE FOR MOLDING OPERATIONS

[75] Inventors: Mamoru Ozeki, Zama; Akihico Tsuda, Atsugi, both of Japan

[73] Assignee: Toshiba Kikai Kabushiki Kaisha, Tokyo, Japan

[21] Appl. No.: 58,777

[22] Filed: Jun. 5, 1987

[51] Int. Cl.[4] ..... B22D 17/20

[52] U.S. Cl. ..... 164/305; 164/410; 425/420; 425/812

[58] Field of Search ..... 164/305, 410; 425/420, 425/812

[56] References Cited

U.S. PATENT DOCUMENTS 4,538,666 9/1985 Takeshima et al. ..... 164/305
4,691,755 9/1987 Kuriyama et al. ..... 164/305

FOREIGN PATENT DOCUMENTS 58-90364 5/1983 Japan ..... 164/305

*Primary Examiner*—Kuang Y. Lin
*Attorney, Agent, or Firm*—Banner, Birch, McKie & Beckett

[57] ABSTRACT

A gas venting device for molding operations is disclosed having a valve for closing off a gas evacuation system from a mold when the mold cavity is filled with melt. A positive drive mechanism is provided for closing the valve, and a mechanism is provided for allowing the valve body to close more rapidly by action of the melt itself against the valve body in the event the melt advances more rapidly through the gas vent passages than expected.

18 Claims, 4 Drawing Sheets

GAS VENTING DEVICE FOR MOLDING OPERATIONS

BACKGROUND OF THE INVENTION

This invention relates to a gas venting arrangement for use with a molding machine, such as one used in die-casting operations.

In die-casting operations a quantity of molten metal is injected into a die cavity which has a shape corresponding to the shape of the final die-cast product. In order to ensure a substantially void-free die casting, the mold cavity is placed under vacuum throughout the melt injection process to remove as much gaseous material as possible from the mold cavity. One type of commonly used gas evacuation or venting arrangement incorporates a shut-off valve for controlling gas flow out of the mold cavity through a gas vent passage. The valve remains open during injection and, when the mold cavity is filled with melt, the valve closes to prevent the vacuum source from ingesting any excess melt which may flow out of the mold and through the gas vent passage.

Valved gas venting devices of the prior art generally are of two types, both typically involving a reciprocating valve body which cooperates with an annular seat. In one type the movement of the valve body to its closed position is accomplished by a positive drive mechanism which is synchronized with melt injection so as to close when the mold cavity is full. Morton U.S. Pat. No. 3,121,926 discloses one example of this type of arrangement, wherein a trigger switch actuated by the injection ram initiates valve closure. Thurner U.S. Pat. No. 4,463,793 discloses another example of this type of arrangement. These types of positively driven gas vent valves, while effective, are not foolproof, inasmuch as rapidly advancing melt in some instances may reach the valve body before it is completely closed, thereby fouling the valve and seat, preventing full closure and clogging the evacuation system.

The other type of valve arrangement used in the prior art involves a melt-driven valve body wherein movement of the valve body to its closed position is effected by pressure or dynamic forces exerted by the melt itself directly on the valve body. In many situations, such as that disclosed by Takeshima U.S. Pat. No. 4,431,047, the valve body is spring-biased to its open position, dynamic melt forces supposedly being sufficient to overcome the spring force and move the valve body to its closed position. However, as recognized by Takeshima in his later U.S. Pat. No. 4,489,771, such an arrangement is not foolproof because the valve body can oscillate due to serial impingement of discontinuous melt (i.e, having one or more voids) which momentarily relieves pressure on the valve body and allows it to re-open. Momentary opening of the valve in the presence of the melt can lead to fouling of the sealing surfaces and invasion of melt into the evacuation chamber. Accordingly, Takeshima in U.S. Pat. No. 4,489,771 provides a complex biasing and triggering mechanism which reverses the bias on the valve body (i.e., towards its closed position) upon initial impingement of the melt. While this arrangement may preclude valve body oscillation, it is not clear whether the closing spring force on the valve body is sufficient in all instances to seal the valve body against the valve seat if some melt has reached the valve seat and interferes with closure. Hodler U.S. Pat. No. 3,885,618 discloses a melt-actuated valve body which floats freely in the valve chamber (when the mold is closed). Hodler relies on the configuration of the valve body to make an effective seal when it retracts within the seat, but there is no guarantee that the pressure of the melt itself acting on the valve body can overcome any obstruction that may be present between the sealing surfaces caused by solidified melt which may have splashed past the valve body and into the seat.

SUMMARY OF THE INVENTION

It is, therefore, an object of the present invention to overcome the above-noted and other shortcomings and disadvantages of the prior art by providing a gas venting device for molding operations which reliably isolates the vacuum system from the mold cavity when the mold cavity is filled with melt with virtually no invasion of melt into the evacuation system prior to valve closure.

Another object of the invention is to provide such a gas venting device having a positive valve closure mechanism which will overcome any obstruction between the valve body and the valve seat.

Another object of the invention is to provide such a gas venting device wherein the valve body is more rapidly advanced toward closure by the melt itself if melt advancing through the gas vent passage overtakes the positively driven valve body, virtually precluding invasion of melt into the evacuation system under all circumstances.

These and other objects of the invention are accomplished by a gas venting arrangement for use with molding apparatus including a mold having a cavity to be filled with melt, means for injecting melt into the mold cavity and a gas vent passage communicating with the mold cavity for evacuating gas from the mold cavity ahead of advancing melt as it fills the mold cavity. The gas venting arrangement comprises a housing having a valve chamber with an inlet adapted to be placed in fluid communication with the gas vent passage, and an exhaust port for evacuating gas from the valve chamber. An annular valve seat adjacent the inlet cooperates with a valve body coaxial with the valve chamber and the valve seat, the valve body having a valve stem extending rearwardly through the valve chamber away from the mold. The valve body is axially movable forwardly, toward the mold, to open the inlet, and movable rearwardly, away from the mold, to close the inlet in cooperation with the valve seat. Valve actuation means is associated with the housing and is operatively coupled to the valve stem for positively driving the valve body rearwardly to positively close the inlet when the mold is full of melt, and permitting the valve body to be driven rearwardly more rapidly by the melt itself to close the inlet if melt advancing through the gas vent passage overtakes the positively driven valve body.

Preferably, the valve actuation means also positively drives the valve body forwardly to forcibly open the inlet before melt is injected into the mold cavity. This may include a double-acting fluid cylinder and piston assembly acting on a reciprocable drive member which is operatively coupled to the valve stem. The coupling arrangement provides for free valve body movement between the open and closed positions when the fluid cylinder is not pressurized. This enables the operator to check for obstructions when the mold is open, and permits the valve body to be driven toward closure more rapidly by the melt itself than it is by the fluid cylinder and piston assembly in the event the advancing melt overtakes the valve body.

BRIEF DESCRIPTION OF THE DRAWINGS

Other features and advantages of the invention can be more fully understood from the following detailed description of a preferred embodiment taken in conjunction with the accompanying drawings, in which.

DETAILED DESCRIPTION

Figure 1:
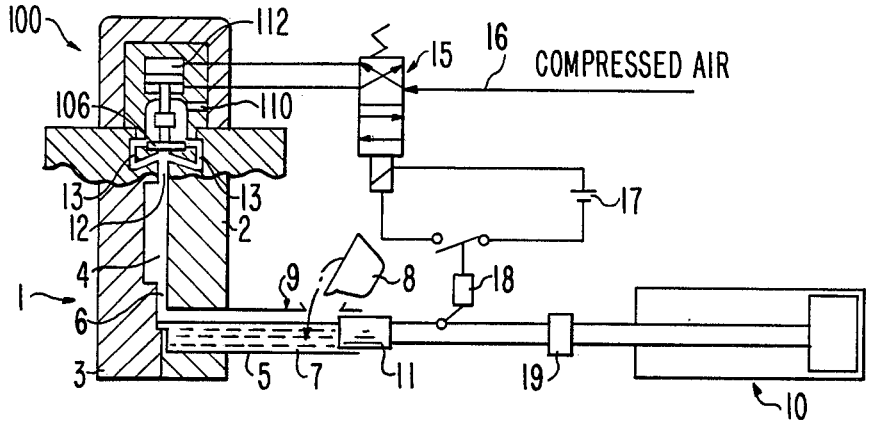
FIGS. 1, 2 and 3 are schematic representations of die-casting apparatus incorporating the gas venting device according to the invention, showing progressive phases of the die-casting and gas venting operation.
Figure 2:
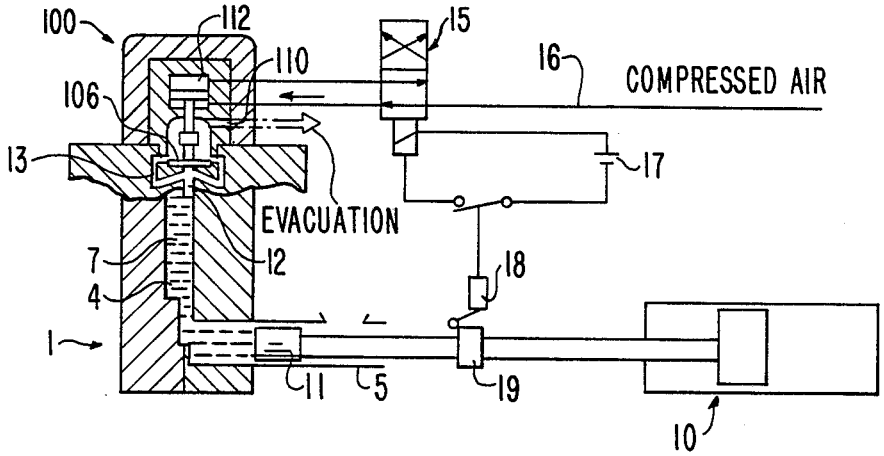
Figure 3:
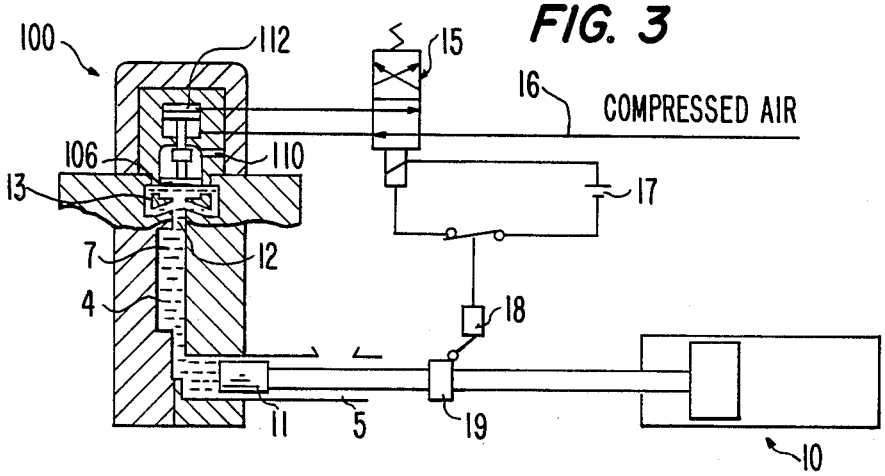

Referring to FIGS. 1, 2 and 3, die casting apparatus is schematically shown which comprises a die or mold 1 having stationary and movable mold sections 2, 3, respectively, which define a mold cavity 4 therebetween. An injection chamber 5 communicates with mold cavity 4 through an inlet passage 6. Injection chamber 5 is charged with molten metal 7 from a crucible 8 or other source of melt through funnel 9. An injection ram 10 drives an injection piston 11 through injection chamber 5 to force melt 7 into mold cavity 4.

A gas venting device 100 according to the invention and associated evacuation equipment serve to remove gases from mold cavity 4 during the injection process through a gas vent passage 12. As seen more clearly in FIGS. 4, 5 and 6, gas vent passage 12 branches into two by-pass gas vent passages 13 and a main gas vent passage 14. A valve chamber 102 houses a valve seat 104 which cooperates at its lower end with a reciprocable valve body 106 to open and close a gas inlet 108 at the lower end of valve chamber 102. A gas evacuation port 110 is connected to a vacuum or reduced pressure source (not shown) for drawing gases through gas vent passages 12 and 13 and inlet 108 when valve body 106 is in its lower or open position, blocking the upper end of main gas vent passage 14. Valve body 106 is connected as described below to a pneumatic cylinder and piston assembly 112 which effects forward (i.e., toward the mold) and rearward (i.e., away from the mold) movement of valve body 106 to open or close inlet 108.

Referring again to FIGS. 1, 2 and 3, pneumatic cylinder and piston assembly 112 is controlled through a solenoid valve 15 connected at 16 to a source of compressed air. The position of solenoid valve 15 is determined by a control circuit incorporating a DC voltage source 17 and a limit switch 18 which senses a predetermined position of injection piston 11 by interaction with cam 19 located on the drive shaft of injection ram 10.

The molding or die-casting operation now will be generally described with reference to FIGS. 1, 2 and 3. FIG. 1 illustrates the configuration of the system just prior to injection of melt into mold cavity 4. As described in more detail below, compressed air from source 16 delivered to the upper port of pneumatic cylinder and piston assembly 112 keeps valve body 106 in its lowermost or open position, poised for positive upward movement by pneumatic cylinder and piston assembly 112 when mold cavity 4 is filled with melt. Limit switch 18 is open in this configuration. FIG. 2 illustrates the configuration of the molding equipment when mold cavity 4 is substantially filled with melt. At this point, the melt is just beginning to rise into main gas vent passage 12, and limit switch 18 has just been tripped to a closed position by cam 19, causing solenoid valve 15 to deliver compressed air to the underside of the piston in pneumatic cylinder and piston assembly 112, driving valve body 106 upwardly toward its closed position. By the time inlet 108 is closed by valve body 106 (FIG. 3), injection piston 11 has moved a little farther to the left and melt has risen through main gas vent passage 12 into by-pass gas vent passages 13. The forceful upward movement of valve body 106 is sufficient to close inlet 108 before melt advancing through by-pass gas vent passages 13 has a chance to invade valve chamber 102. However, in the event melt advances through the gas vent passages faster than expected, the unique coupling between valve body 106 and pneumatic cylinder and piston assembly 112 (described below in detail) allows the advancing melt in main gas vent passage 14 to push valve body 106 home to its closed position before melt can invade the inlet 108 through by-pass gas vent passages 13.

Once molding has been completed, movable die portion 3 is opened, the molded part is removed and excess melt is cleared from the gas vent passages and the lower face of valve body 106. With solenoid valve 15 in the position illustrated in FIG. 1, compressed air supplied at 16 again will force valve body 106 downwardly to its open position, facilitating cleaning of the valve body and adjacent surfaces. With cleaning complete and the mold reassembled, the molding process then may be repeated.

Figure 4:
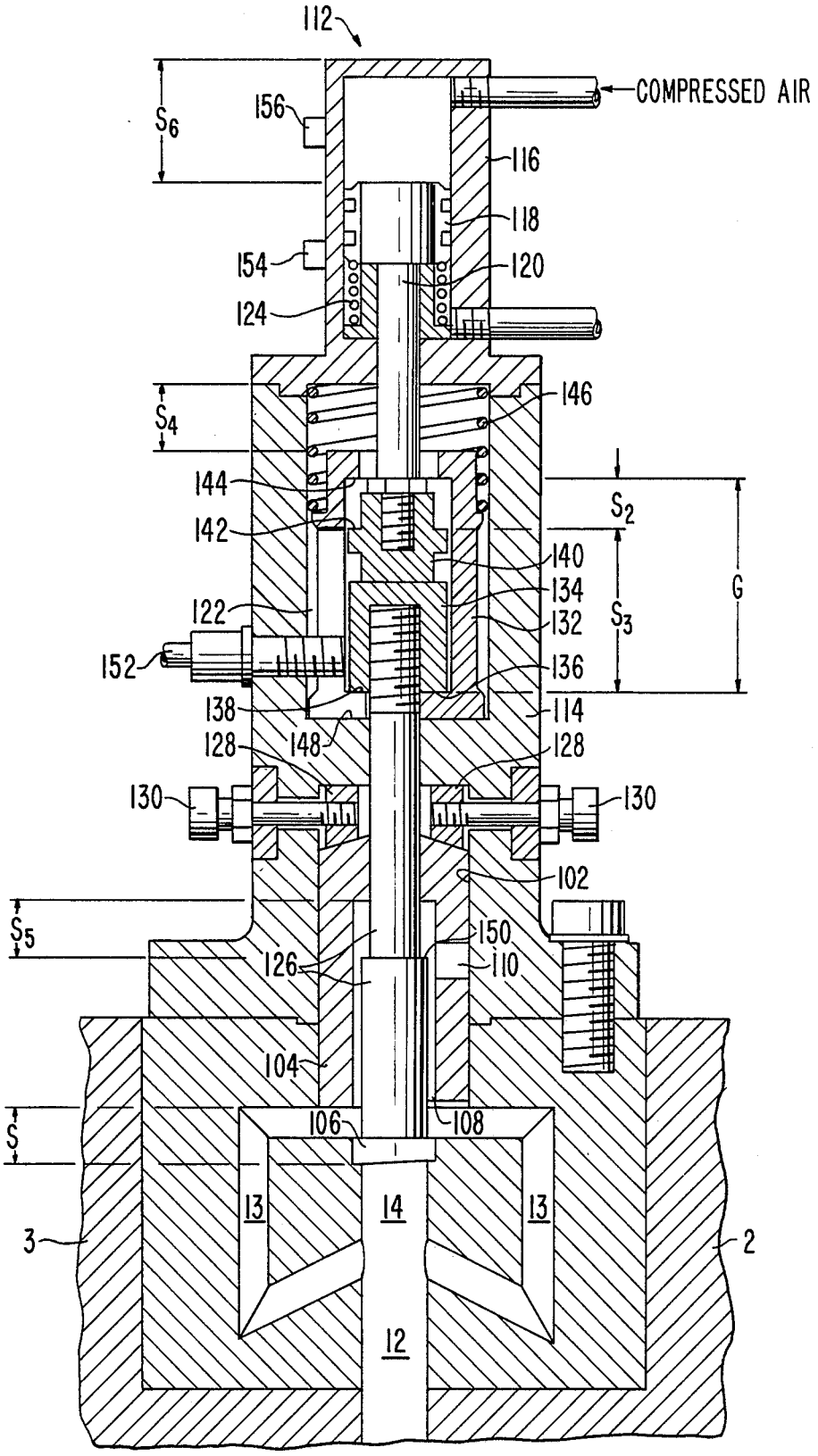
FIGS. 4, 5 and 6 are vertical sectional views of the gas venting device according to the invention shown in different phases of the die-casting and gas evacuation operation.
Figure 5:
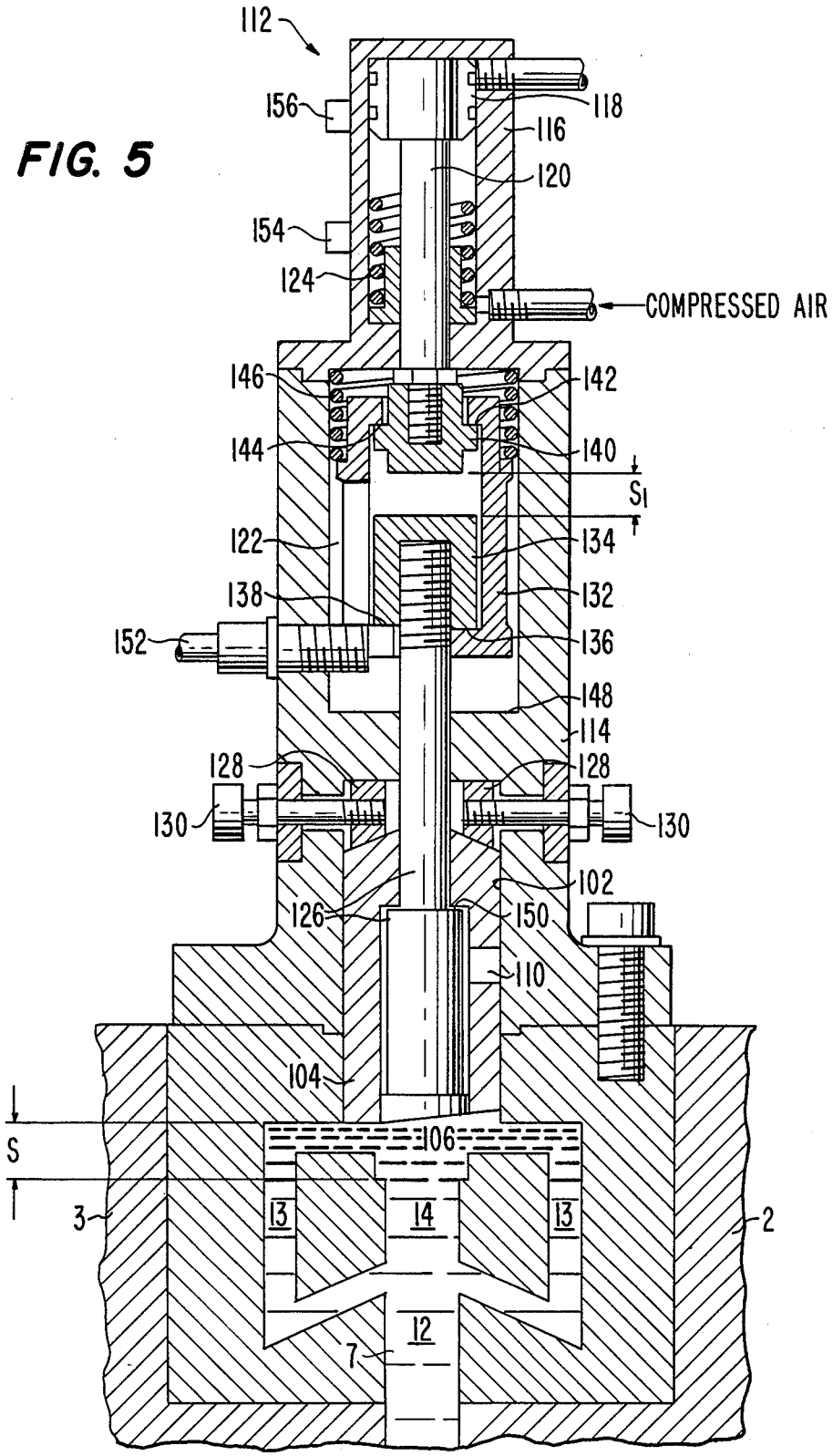
Figure 6:
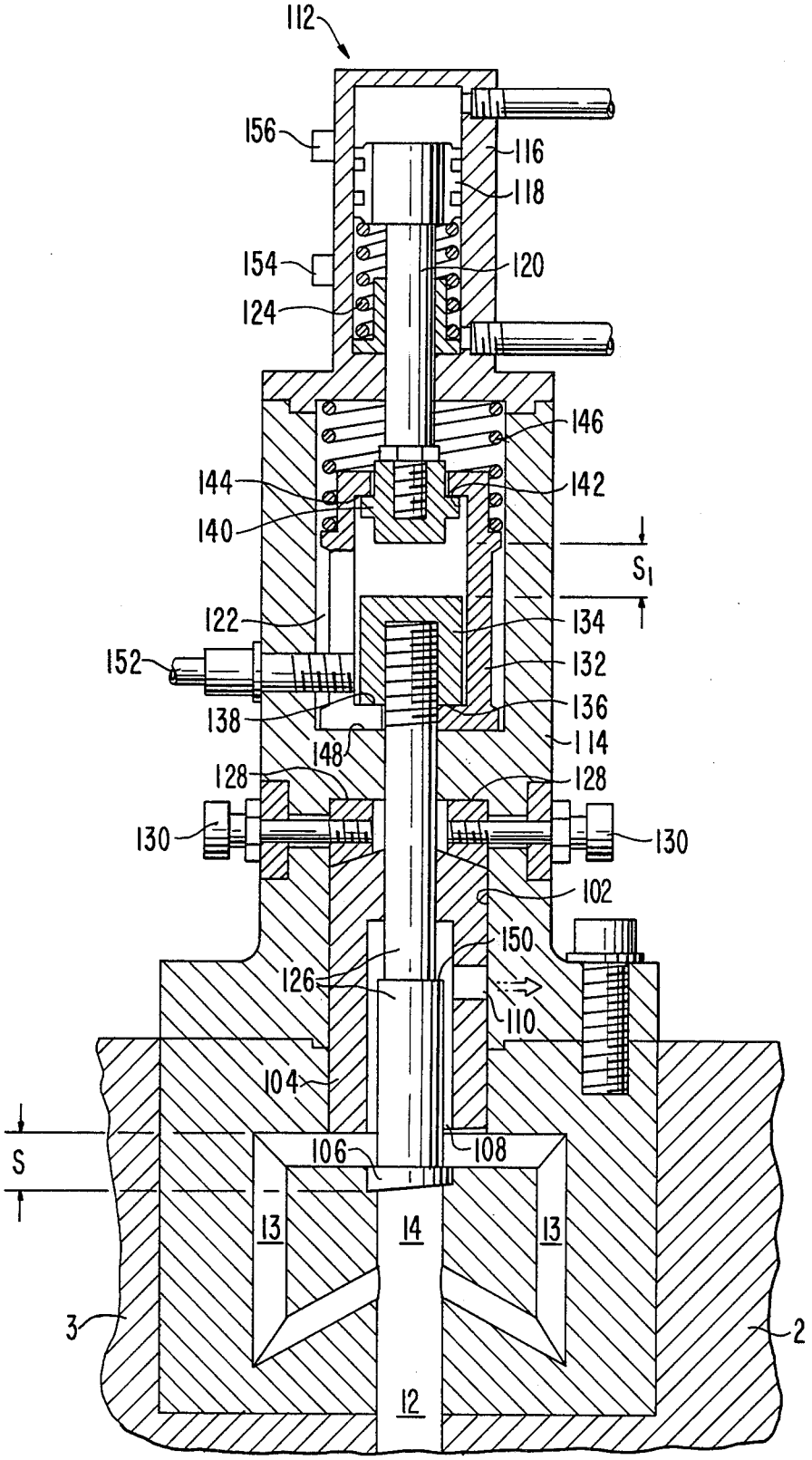

Referring to FIGS. 4, 5 and 6, the gas venting device according to the invention now will be described in detail. Valve chamber 102 is contained within a housing 114, at the top or rear end of which is located pneumatic cylinder and piston assembly 112. This assembly comprises a cylinder 116 housing a piston 118 which is connected to a drive member or rod 120 extending forwardly into a coupling chamber 122. A piston-engaging coil spring 124 within cylinder 116 exerts a rearward bias on piston 118 and drive rod 120. Valve body 106 is mounted at the end of a valve stem 126 which extends rearwardly through valve chamber 102 into coupling chamber 122. The position of valve seat 104 is adjustable by means of tapered seat adjusting blocks 128 which can be externally manipulated by means of adjusting screws 130.

Drive rod 120 and valve stem 126 are coaxial and their distal ends are coupled by a sliding joint 132 located in coupling chamber 122. A valve stem nut 134 is threaded onto the end of valve stem 126 and has a forwardly facing shoulder 136 which cooperates with a rearwardly facing shoulder 138 at the forward end of sliding joint 132. Similarly, a drive rod nut 140 threaded onto the end of drive rod 120 has a rearwardly facing shoulder 142 which is adapted to mate with a forwardly facing shoulder 144 at the rear end of sliding joint 132. A joint-engaging coil spring 146 in coupling chamber 122 exerts a forward bias on sliding joint 132 toward its foremost position against the front end 148 of coupling chamber 122. The forward biasing force of spring 146 is greater than the rearward biasing force of spring 124. Thus, with valve body 106 in its foremost or open position and cylinder 116 unpressurized, the working parts are in the configuration shown in FIG. 6, with a spacing $S_1$ between the ends of valve stem nut 134 and drive rod nut 140. In this "check" position valve body 106 and valve stem 126 are freely movable, which allows the operator to manually check the freedom of movement of valve body 106 before the mold is reclosed for further molding. As explained more fully below, this free play in the coupling mechanism also permits melt-driven movement of valve body 106 during valve closure in the event melt advances more rapidly than normal toward valve chamber 102.

The sizing and spacing of the various working components of the gas venting device preferably is as follows. Valve body 106 (and valve stem 126) must undergo a stroke S defined by the fully open position shown in FIGS. 4 and 6 (blocking main gas vent passage 14) and the fully closed position shown in FIG. 5 (retracted within valve seat 104). The shoulder 150 on valve stem 126 is located at a spacing $S_5$ from the rear end of valve seat 104 with the valve in the open position, where $S_5$ is equal to or greater than stroke S. This spacing of course allows valve body 106 to move through a complete stroke when closing. Similarly, with sliding joint 132 in its foremost position (see FIG. 4), the spacing $S_4$ between its rear end and the rear end of joint chamber 122 must be equal to or greater than stroke S. This also holds true for the spacing $S_6$ between the rear end of piston 118 and the rear end of cylinder 116, since rearward movement of piston 118 causes drive rod nut 140 to lift sliding joint 132 and, in turn, lift valve stem nut 134 along with valve stem 126 and valve body 106. Gap G between the front and rear shoulders 138, 144 of sliding joing 132 must exceed the minimum spacing between shoulder 142 on drive rod nut 140 and shoulder 136 on valve stem nut 134 ($S_3$) by a distance $S_2$ which is at least equal to stroke S. Of course, spacing $S_1$ (FIG. 6) must equal spacing $S_2$.

Certain ancillary control elements may be used to provide data on the positions of certain working parts of the gas venting device, which can be utilized for automatic control, if desired. Thus, a magnetic or optical position sensor 152 detects the position of valve stem nut 134, while magnetic limit switches 154, 156 detect the position of piston 118 within cylinder 116. Other position detectors and controllers may be provided as necessary for indicating the condition of the various working elements of the gas venting device.

The operation of the gas venting device according to the invention now will be described in detail, with reference to FIGS. 4, 5 and 6. FIG. 4 illustrates the configuration of the device when cylinder 116 is pressurized to drive valve stem 126 forwardly to force valve body 106 to its open position. This typically would be done after the mold has been opened to return valve body 106 to its open position for cleaning and inspection. Before the mold is reclosed cylinder 116 is depressurized which permits the working parts to assume the "check" configuration shown in FIG. 6. As explained above, because of the relative biasing forces of springs 124 and 146, sliding joint 132 assumes its foremost position while drive rod nut 140 abuts the rear shoulder 144 of sliding joint 132. This leaves valve body 126 free to move so that the operator can manually check for any obstructions in or around inlet 108 and insure freedom of movement of valve body 106.

FIG. 4 also illustrates the configuration of the device during the melt injection phase, when gases are evacuated through gas vent passages 12 and 13, inlet 108 and exhaust port 110. In this configuration pneumatic cylinder and piston assembly 112, while maintaining valve body 106 in the open position, remains poised to drive valve stem 126 and valve body 106 rearwardly to the closed position when compressed air is supplied to the lower port of cylinder 116. When this occurs (FIG. 5) valve stem 126 and valve body 106 are driven rearwardly at a rapid rate. However, if melt advances through the gas vent passages more rapidly than expected so as to overtake valve body 106 in main gas vent passage 14, the play $S_1$ between valve stem nut 134 and drive rod nut 140 allows the melt itself to drive valve body 106 home to its fully closed position before piston 118 completes its rearward stroke and before melt advancing through bypass gas vent passages 13 can foul valve body 106 and valve seat 104, thus precluding invasion of melt through inlet 108 into valve chamber 102.

As illustrated in FIGS. 4, 5 and 6, the forward face of valve body 106 and the forward end of valve seat 104 are machined at a slight angle to a plane perpendicular to the axis of the valve body and valve stem. This facilitates removal of melt which may have adhered to these surfaces. Cleaning also may involve complete removal of the gas venting device from the portion of the mold to which it is bolted.

From the foregoing it will be seen that the gas venting device according to the invention efficiently accomplishes its objectives. Pneumatic cylinder and piston assembly 112 provides a positive closing force for the valve which helps valve body 106 overcome any obstruction. The ability of valve body 106 to undergo more rapid, melt-driven closure ensures that virtually no melt can find its way through inlet 108 into valve chamber 102. Although disclosed as usable in connection with die-casting operations, the gas venting device according to the invention is equally applicable to other types of molding operations involving gas evacuation, such as the injection molding of plastic or other types of materials. Modifications to the disclosed preferred embodiment will be apparent to those skilled in the art. For example, cylinder and piston assembly 112 may be hydraulically driven, rather than pneumatically actuated. Coupling means other than that illustrated and described in coupling chamber 122 may be provided which performs substantially the same function. Other modifications will be apparent to those skilled in the art without departing from the true scope of the invention which is defined by the appended claims.

We claim:

1. A gas venting arrangement for use with molding apparatus including a mold having a cavity to be filled with a melt, means for injecting melt into the mold cavity and a gas vent passage communicating with the mold cavity for evacuating gas from the mold cavity ahead of advancing melt as it fills the mold cavity, said gas venting arrangement comprising:

a housing having a valve chamber with an inlet adapted to be placed in fluid communication with the gas vent passage, and an exhaust port for evacuating gas from said valve chamber;

an annular valve seat adjacent said inlet;

a valve body coaxial with said valve chamber and said valve seat and having a valve stem extending rearwardly through said valve chamber away from the mold, said valve body being axially movable forwardly, toward the mold, to open said inlet, and movable rearwardly, away from the mold, to close said inlet in cooperation with said valve seat; and valve actuation means associated with said housing and including a positively driven, reciprocable drive member and coupling means interconnecting said drive member and said valve stem for transmitting rearward movement of said drive member to said valve stem to positively close said inlet when the mold is full of melt, and permitting said valve body to be driven rearwardly more rapidly by the melt itself to close said inlet if melt advancing through the gas vent passage overtakes the positively driven valve body.

2. A gas venting arrangement according to claim 1 wherein said valve actuation means also positively drives said valve body forwardly to forcibly open said inlet before melt is injected into the mold cavity.

3. A gas venting arrangement according to claim 1 wherein said valve actuation means also positively drives said drive member forwardly against said valve stem to forcibly open said inlet before melt is injected into the mold cavity.

4. A gas venting arrangement according to claim 1 wherein said drive member comprises an elongated, axially reciprocable drive member positioned rearwardly of and coaxial with said valve stem.

5. A gas venting arrangement according to claim 4 wherein said coupling means comprises a forwardly facing shoulder on the distal end of said valve stem, a rearwardly facing shoulder on the distal end of said drive member, and a sliding joint embracing the distal ends of said valve stem and said drive member and having front and rear mutually facing shoulders which mate respectively with said forwardly and rearwardly facing shoulders on said valve stem and said drive member, the gap between said front and rear shoulders of said sliding joint being greater than the minimum spacing between the shoulders on the distal ends of said valve stem and said drive member.

6. A gas venting arrangement according to claim 5 wherein said gap between said front and rear shoulders of said sliding joint exceeds the minimum spacing between the shoulders on the distal ends of said valve stem and said drive member by at least the stroke of said valve body between its fully open and fully closed positions.

7. A gas venting arrangement according to claim 6 wherein said valve actuation means also positively drives said drive member forwardly through said sliding joint and into engagement with said valve stem to forcibly open said inlet before melt is injected into the mold cavity.

8. A gas venting arrangement according to claim 5 or 6 wherein said coupling means further comprises a joint-engaging spring exerting a forward bias on said sliding joint.

9. A gas venting arrangement according to claim 8 wherein said valve actuation means comprises a fluid cylinder and piston assembly operatively coupled to and driving said drive member, said cylinder and piston assembly including a piston-engaging spring in said cylinder exerting a rearward bias on said drive member, said forward bias on said sliding joint exceeding said rearward bias on said drive member whereby, when said cylinder and piston assembly is not pressurized, said sliding joint is kept in its foremost position with said inlet open and the shoulder on said drive member is engaged with said rear shoulder on said sliding joint.

10. A gas venting arrangement according to claim 9 wherein said cylinder and piston assembly is double-acting and also positively drives said drive member forwardly, against the action of said piston-engaging spring, through said sliding joint and into engagement with said valve stem to forcibly open said inlet before melt is injected into the mold cavity.

11. A gas venting arrangement according to claim 1 or 6 wherein said valve body and said valve seat are cylindrical and are dimensioned so that said valve body can retract fully within said valve seat to close said inlet.

12. A gas venting arrangement according to claim 11 wherein the forward face of said valve body and the forward end of said valve seat are angled slightly with respect to a plane perpendicular to the axis of said valve body.

13. A gas venting arrangement for use with molding apparatus including a mold having a cavity to be filled with a melt, means for injecting melt into the mold cavity and a gas vent passage communicating with the mold cavity for evacuating gas from the mold cavity ahead of advancing melt as it fills the mold cavity, said gas venting arrangement comprising:

a housing having a valve chamber with an inlet adapted to be placed in fluid communication with the gas vent passage, and an exhaust port for evacuating gas from said valve chamber;

a cylindrical valve seat adjacent said inlet;

a cylindrical valve body coaxial with said valve chamber and said valve seat and having a valve stem extending rearwardly through said valve chamber away from the mold, said valve body being axially movable forwardly, toward the mold, to open said inlet, and movable rearwardly, away from the mold, to retract fully within said valve seat and thereby close said inlet;

a double-acting fluid cylinder and piston assembly at the rear of said housing having a drive rod coaxial with and extending forwardly toward said valve stem; and coupling means in said housing, intermediate said valve chamber and said cylinder and piston assembly, interconnecting said drive rod and said valve stem for transmitting rearward movement of said drive rod to said valve stem to positively close said inlet when the mold is full of melt, while permitting faster melt-driven rearward movement of said valve body if the inlet is not closed when melt reaches said valve body, and for transmitting forward movement of said drive rod to said valve stem to forcibly open said inlet before melt is injected into the mold cavity, said coupling means comprising a forwardly facing shoulder on the distal end of said valve stem, a rearwardly facing shoulder on the distal end of said drive rod, and a sliding joint embracing the distal ends of said valve stem and said drive rod and having front and rear mutually facing shoulders which mate respectively with said forwardly and rearwardly facing shoulders on said valve stem and said drive rod, the gap between said front and rear shoulders of said sliding joint being greater than the minimum spacing between the shoulders on the distal ends of said valve stem and said drive rod.

14. A gas venting arrangement according to claim 13 wherein said gap between said front and rear shoulders of said sliding joint exceeds the minimum spacing between the shoulders on the distal ends of said valve stem and said drive rod by at least the stroke of said valve body between its fully open and fully closed positions.

15. A gas venting arrangement according to claim 14 wherein said coupling means further comprises a joint-engaging spring exerting a forward bias on said sliding joint.

16. A gas venting arrangement according to claim 15 wherein said cylinder and piston assembly includes a piston-engaging spring in said cylinder exerting a rearward bias on said drive rod, said forward bias on said sliding joint exceeding said rearward bias on said drive rod whereby, when said cylinder and piston assembly is not pressurized, said sliding joint is kept in its foremost position with said inlet open and the shoulder on said drive rod is engaged with said rear shoulder on said sliding joint.

17. A gas venting arrangement according to claim 16 wherein the forward face of said valve body and the forward end of said valve seat are angled slightly with respect to a plane perpendicular to the axis of said valve body.

18. A gas venting arrangement for use with molding apparatus including a mold having a cavity to be filled with a melt, means including an injection ram for injecting melt into the mold cavity and a gas vent passage communicating with the mold cavity for evacuating gas from the mold cavity ahead of advancing melt as it fills the mold cavity, said gas venting arrangement comprising:

a housing having a valve chamber with an inlet adapted to be placed in fluid communication with the gas vent passage, and an exhaust port for evacuating gas from said valve chamber;

a cylindrical valve seat adjacent said inlet;

a cylindrical valve body coaxial with said valve chamber and said valve seat and having a stem extending rearwardly through said valve chamber away from the mold, said valve body being axially movable forwardly, toward the mold, to open said inlet, and movable rearwardly, away from the mold, to retract fully within said valve seat and thereby close said inlet;

means for detecting a predetermined position of the injection ram at which the mold cavity is substantially filled with melt, and for producing a signal when the injection ram reaches said predetermined position;

a double-acting fluid cylinder and piston assembly at the rear of said housing having a drive rod coaxial with and extending forwardly toward said valve stem; and coupling means in said housing, intermediate said valve chamber and said cylinder and piston assembly, interconnecting said drive rod and said valve stem, for transmitting rearward movement of said drive rod to said valve stem, in response to said signal produced by said detecting means, to positively close said inlet when the mold is full of melt, and before the advancing melt reaches and contacts said valve body, and for transmitting forward movement of said drive rod to said valve stem to forcibly open said inlet before melt is injected into the mold cavity, said coupling means comprising a forwardly facing shoulder on the distal end of said valve stem, a rearwardly facing shoulder on the distal end of said drive rod, and a sliding joint embracing the distal ends of said valve stem and said drive rod and having front and rear mutually facing shoulders which mate respectively with said forwardly and rearwardly facing shoulders on said valve stem and said drive rod, the gap between said front and rear shoulders of said sliding joint being greater than the minimum spacing between the shoulders on the distal ends of said valve stem and said drive rod.

* * * * *